US007450471B1

(12) United States Patent
Schlegg et al.

(10) Patent No.: US 7,450,471 B1
(45) Date of Patent: Nov. 11, 2008

(54) AUTOMATIC DIVER IDENTIFICATION UNIT

(76) Inventors: Bradley R. Schlegg, 1122 S. Fisk, Green Bay, WI (US) 54304; Gerald L. Townsend, W. 6832 Fairgrounds Rd., Wausaukee, WI (US) 54177; Randall L. Fraatz, 2522 Sussex St., Green Bay, WI (US) 54311

( * ) Notice: Subject to any disclaimer, the term of this patent is extended or adjusted under 35 U.S.C. 154(b) by 477 days.

(21) Appl. No.: 11/225,531

(22) Filed: Sep. 13, 2005

Related U.S. Application Data

(60) Provisional application No. 60/609,574, filed on Sep. 14, 2004.

(51) Int. Cl.
*B63B 22/18* (2006.01)

(52) U.S. Cl. ..... 367/131

(58) Field of Classification Search ..... 367/128, 367/131; 441/6, 21, 23, 26
See application file for complete search history.

(56) References Cited

U.S. PATENT DOCUMENTS

| | | | | | |
|---|---|---|---|---|---|
| 1,588,798 | A * | 6/1926 | Moore | 441/26 |
| 3,084,652 | A * | 4/1963 | Lager | 114/65 R |
| 3,193,854 | A * | 7/1965 | Butka et al. | 441/26 |
| 4,123,813 | A * | 11/1978 | Adams | 441/11 |
| 4,185,326 | A * | 1/1980 | Whittaker | 367/96 |
| 4,756,486 | A * | 7/1988 | Campbell | 242/396.9 |
| 5,067,920 | A * | 11/1991 | Brisky | 441/26 |
| 5,082,464 | A | 1/1992 | Clink | |
| 5,173,067 | A * | 12/1992 | Biba | 441/25 |
| 5,640,922 | A * | 6/1997 | Feldkamp et al. | 441/6 |
| 6,273,773 | B1 * | 8/2001 | Bourke | 441/6 |
| 6,791,490 | B2 * | 9/2004 | King | 441/26 |
| 7,001,235 | B2 * | 2/2006 | Baldwin | 441/6 |
| 2005/0082409 | A1 * | 4/2005 | Jundt et al. | 242/390.8 |

* cited by examiner

*Primary Examiner*—Dan Pihulic
(74) *Attorney, Agent, or Firm*—Andrus, Sceales, Starke & Sawall, LLP

(57) ABSTRACT

An automatic diver identification unit for providing motorized and multi-directional surface movement relative to a position of an underwater diver and to identify the position of a diver at the surface of a body of water. The automatic diver identification unit includes a buoyant main body portion having at least one interior chamber. An electronic control system is included within the automatic diver identification unit, and includes a diver movement detection switch. The unit operates to provide automated adjustment of a dive line relative to a signal received indicating the depth of the underwater diver. A propulsion means interconnected with the electronic control system identifies movement of the underwater diver and positions the unit above the diver. An identification signal identifies the location of the unit to other persons at the surface of a body of water.

21 Claims, 5 Drawing Sheets

AUTOMATIC DIVER IDENTIFICATION UNIT

CROSS-REFERENCE TO RELATED APPLICATIONS

This application claims priority from U.S. Provisional Patent Application No. 60/609,574, filed Sep. 14, 2004.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND AND SUMMARY

Underwater divers, particularly scuba divers, often utilize a diver identification means, typically a dive flag, on a float to indicate the position of the diver at the water's surface while he or she is beneath the surface of a body of water. As the dive flag is intended to indicate the position of the diver at the surface of the water, dive flags are commonly attached to floats which have sufficient buoyancy to maintain the flag's position at the surface of the water.

Current diver identification units generally consist of a float, such as a buoy or inflatable tube, with a dive flag mounted thereon so that the flag may be easily seen by others as the float sits on the water's surface.

A dive line, rope or lanyard is also used in conjunction with the flag, float and the diver. One end of the dive line is attached to the float, while the other end is attached to or held by a diver. Divers commonly have a reel or line holder that they will hold onto or somehow attach to the diver that allows the dive line to be taken in or out. As the diver descends, the diver unwinds the line from the reel. Conversely, as the diver ascends, the diver must reel in or rewind the dive line around the holder.

During descent, it is desirable to maintain the identification means generally directly above the diver so that boats or other surface dangers are able to ascertain the location of the diver and the diver can safely dive. However, as the diver descends and the dive line is unwound from the holder, normal wave action will move the float away from the diver. Movement of the float away from the diver occurs at a greater rate when slack is present in the dive line and/or when there is intense wave action due to wind or tides. When the diver wishes to move the identification means to the more desirable position of being located substantially directly above the diver, the diver must reel in or rewind the dive line around the holder to take up the slack and thus pull the float towards the diver. Pulling the float buoy to the proper position while underwater can compromise the safety of the diver as a risk of entanglement in the dive environment may ensue.

Generally, it takes both hands of the diver to reel in or rewind the dive line around a reel or holder. Therefore, a diver is momentarily incapacitated and wastes dive time in order to maintain his or her safety. Additionally, since both hands of a diver are required to modify the position of the float, the diver may become disoriented or may be unaware of other activities in the environment, such as currents, dangerous animals or dangerous geologic features that may even further compromise the safety of the diver. Thus, it can be seen that the requirement of maintaining the dive line generally directly above the diver using conventional equipment makes the dive experience cumbersome and awkward.

Herein is disclosed a hands free flotation device for use in diving. The hands free flotation device disclosed may be described as a diver identification unit that provides motorized and multi-directional surface movement of the unit that supports an identification means for visual identification of an underwater diver's location at the surface of a body of water. The automatic diver identification unit disclosed herein further provides motorized adjustment of a dive line releasably connected to an underwater diver. The motorized movements of the automatic diver identification unit are controlled by an electronic control system and/or sensors, triggers or relays that instruct electrical motors such that the diver identification unit maintains a position substantially above a diver at the surface of a body of water while the diver is submerged.

The unit provides 360° directional movement at the surface of the body of water, based on vertical and horizontal relationships between the unit and the diver. Movement is executed through an automatic motor response that communicates with a propulsion device to drive the movement of the unit on the surface of the water.

The motorized, automatic dive line adjustment is based on the vertical relationship between the automatic diver identification unit and the diver. The dive line is retracted or released by an automatic motor response to sensor and/or trigger inputs. In this manner, a slack-free dive line is maintained between the diver and the unit.

The characteristics and response time of both the propulsion movement and the dive line adjustment is modifiable and programmable by a user of the unit. In this manner, the unit can be adjusted to fit the conditions of the dive environment.

The automatic diver identification unit is also designed for extra storage of articles and items of a diver's choice. The unit is portable, such that a single person can transport the unit from his or her vehicle to the dive site.

Thus, the automatic diver identification unit disclosed herein provides the advantage of hands free diving with an automatic slack free dive line and automatic location adjustment of the unit to maintain a vertical orientation substantially directly above the diver. Through the use of the automatic diver identification unit, a diver need not become preoccupied with maintaining vertical orientation of a float and further need not become preoccupied with safety concerns such as entanglement or disorientation. Therefore, the disclosed automatic diver identification unit increases the safety of divers while further enhancing the diver's dive time and dive experience.

These and other advantages of the present invention will be more clearly realized through the detailed description of the invention in conjunction with the brief description of the drawings.

DETAILED DESCRIPTION

Figure 1:
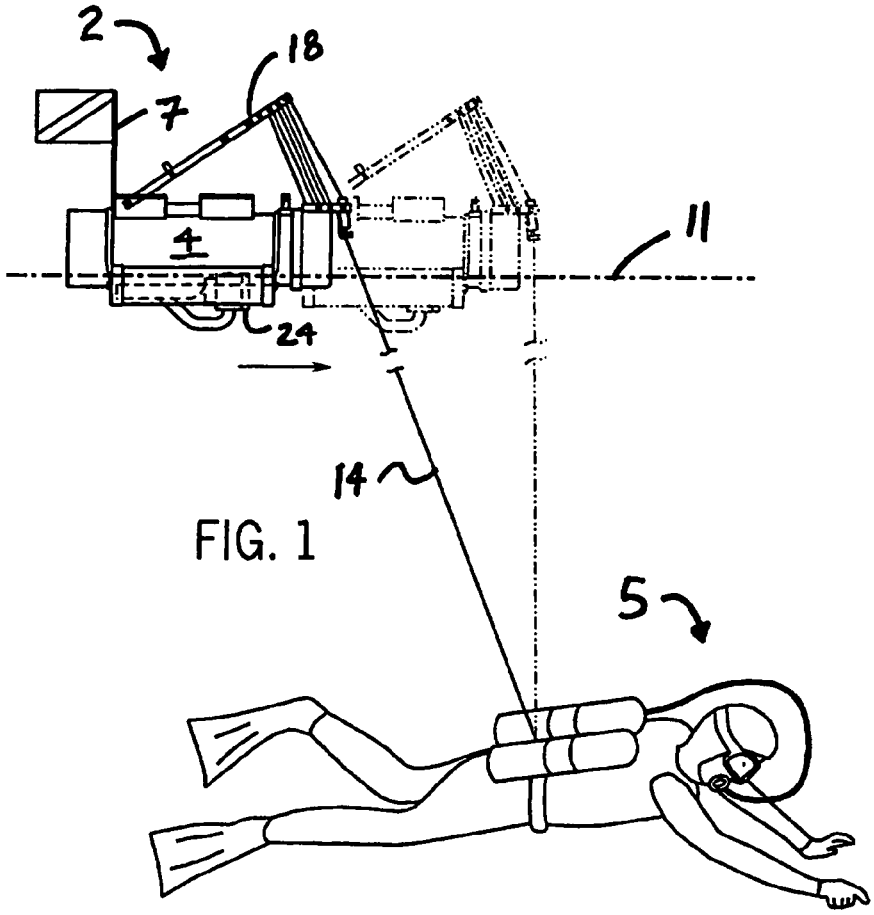
FIG. 1 is an illustrative view of an embodiment of an automatic diver identification unit demonstrating the unit's location at the surface of a body of water while attached via a dive line to an underwater diver, and further demonstrating directional movement of the unit to maintain a location substantially directly above the underwater diver.
Figure 3:
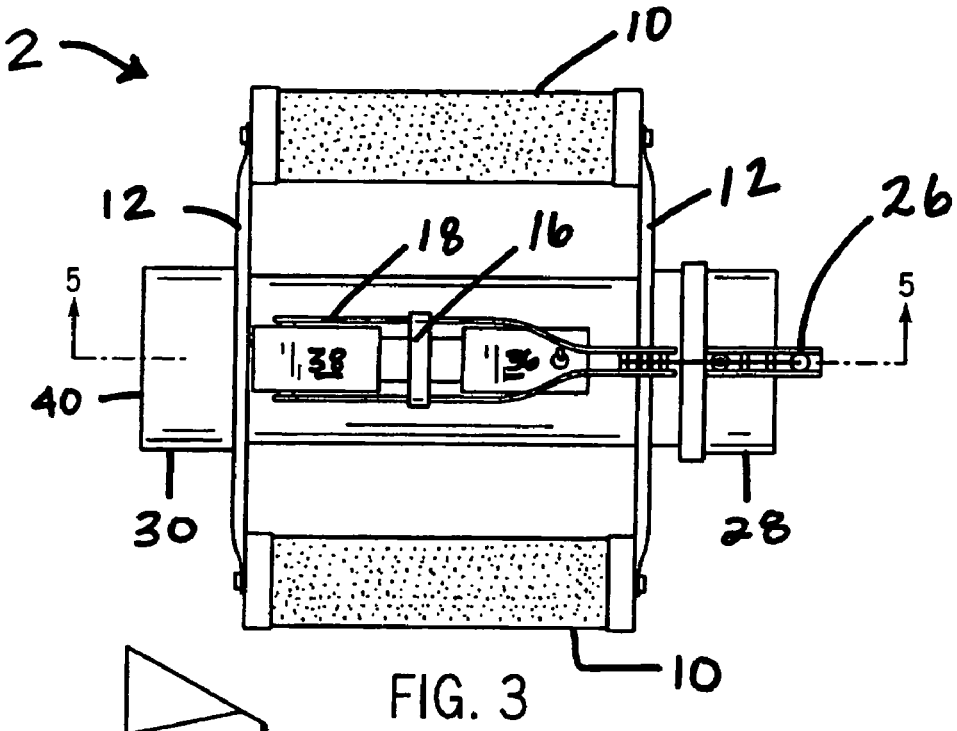
FIG. 3 is a top view of an embodiment of the automatic diver identification unit of the present invention.
Figure 4:
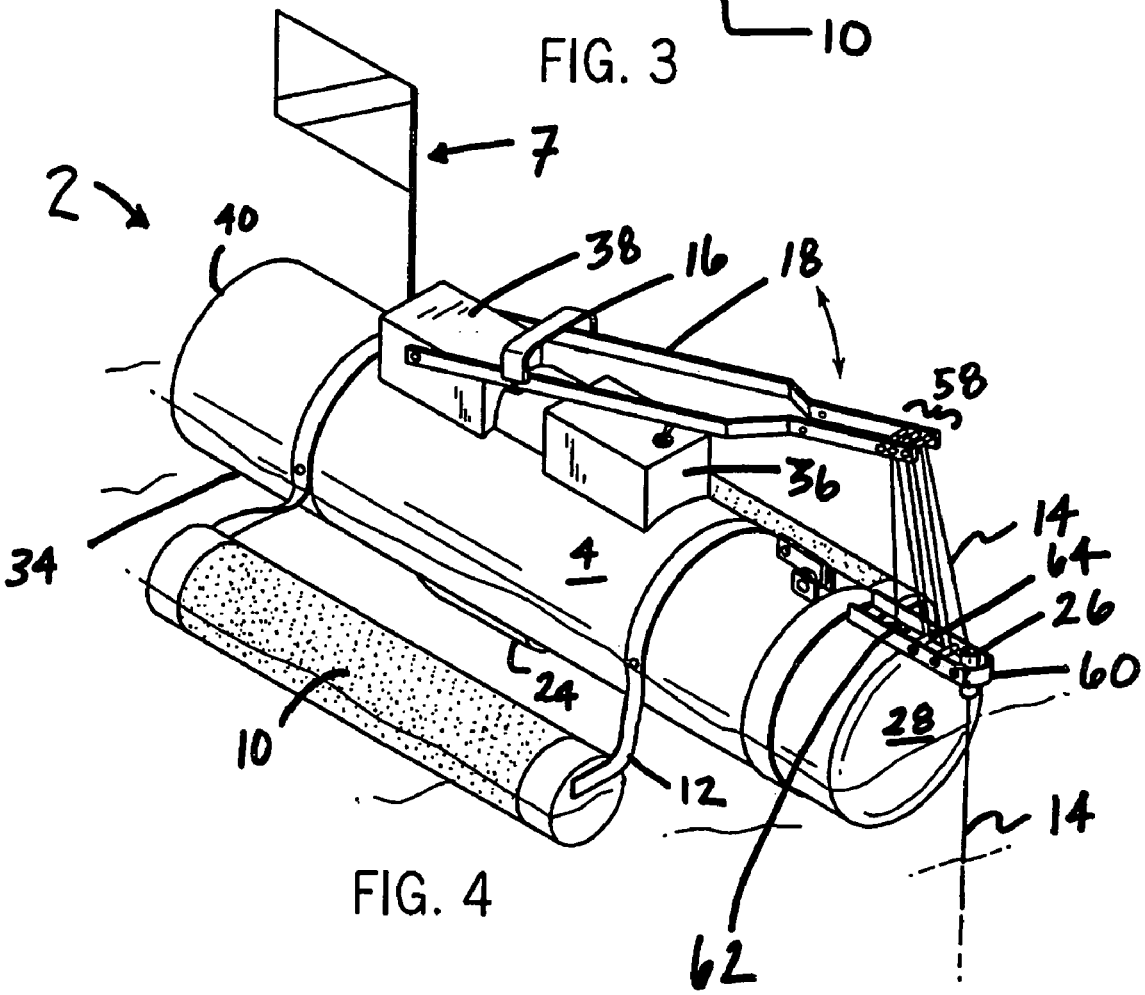
FIG. 4 is a perspective view of an embodiment of the automatic diver identification unit, wherein the unit is located on the surface of a body of water, and further demonstrating movement of a diver depth detection arm.

Referring first to FIGS. 1 and 4, the automatic diver identification unit 2 is demonstrated as a hands free flotation device that supports an identification means 7 of a diver's location when the diver 5 is participating in underwater diving activities. The automatic diver identification unit 2 comprises a main body portion 4 having an outer surface 6 and an inner surface 8. The main body portion 4 has sufficient buoyancy to maintain the unit 2 in an upright position on the surface 11 of a body of water. The automatic diver identification unit 2 may include at least one stabilizing flotation member 10 attached to the main body portion 4. In one embodiment, the unit includes two flotation members 10 that are cylindrical in shape with an elongated longitudinal axis and are constructed of a hollow, air tight, waterproof plastic tube. Alternatively, the flotation means 10 may be constructed other durable flotation material, for example, a fiberglass or foam. In an embodiment disclosed in FIGS. 2, 3 and 4, the flotation means 10 are attached to the main body portion 4 via hinged, rigid braces 12. Rigid braces 12 are preferably made of durable aluminum-based material, but may also be made out of a plethora of other materials, including durable plastics, fiberglass, carbon fiber or stainless steel and is only limited by the manufacturer's preference. In yet another embodiment, the floats 10 may be removable by a diver if desired to accommodate the unit 2 for particular dive conditions. A dive line 14 is attached to the main body portion 4.

The identification means 7 of the automatic diver identification unit 2 is removable and comprises a signal to identify the location of the unit 2 when it is positioned at the surface of a body of water 11 and the diver 5 is diving at a location substantially directly below the unit 2. In one embodiment, the signal is a visual signal and may include, for example, and without limitation, a conventional dive flag, a light, or other visual signals designed to attract one's sense of sight. In another embodiment, the signal may be an audio signal, for example, and without limitation, a siren or other auditory alert signal to attract one's auditory senses. In yet another embodiment, the signal may be a combination visual and audio signal. In still another embodiment, the signal to identify the location of the unit 2 may be a radio signal or satellite signal, such as a global positioning satellite signal, either alone or in combination with a visual and/or audio signal.

Figure 2:
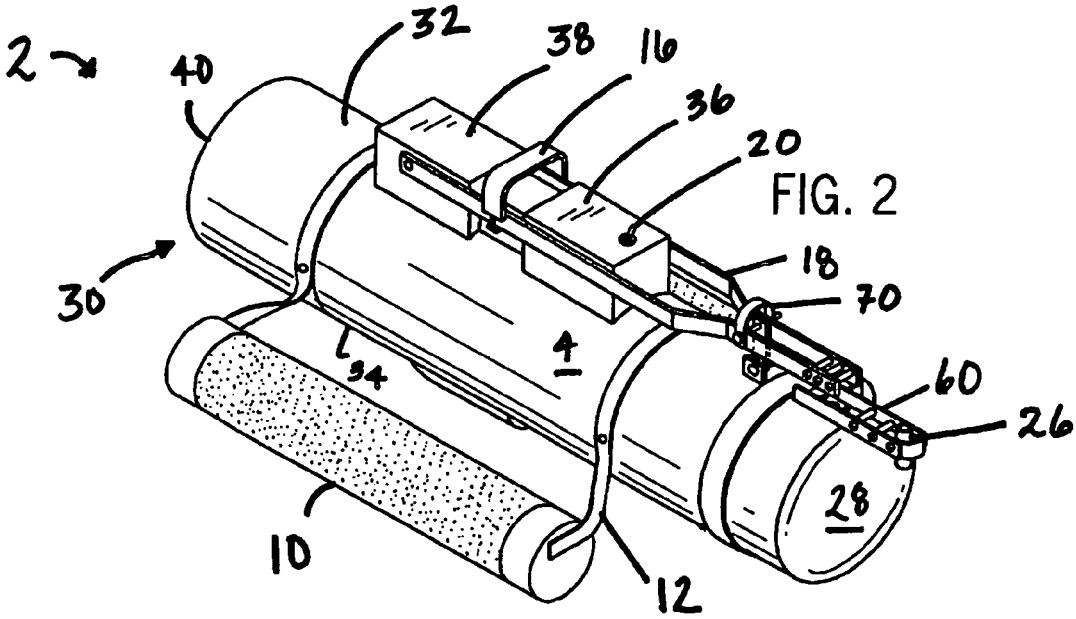
FIG. 2 is a perspective view of an embodiment of the automatic diver identification unit in a folded and locked position for transport.

Referring to FIG. 2, therein the diver identification unit 2 is demonstrated in a closed position for transport. In one embodiment, the unit 2 includes a handle 16 such that a diver may carry the unit 2 from one location to another location. Preferably, the handle 16 operates in conjunction with a flexible diver depth detection arm 18 such that when the unit 2 is in position for transportation, the diver depth detection arm 18 is in a closed position that is parallel with the main body 4 of the diver identification unit 2. A lock pin 70 is used to secure the arm 18 in the locked position. In this manner, the arm 18 is secured longitudinally along a dorsal surface 32 of the main body 4. When arm 18 is secured in the locked position, the carrying handle 16 is in an appropriate condition for use. Accordingly, when the arm 18 is secured in a locked position, the diver may easily grasp handle 16 such that the diver can carry the entire automatic diver identification unit 2, including the stabilizing flotation means 10, from one location to another location.

Referring to FIG. 3, the automatic diver identification unit 2, in one embodiment, locates stabilizing flotation means 10 on both sides of the main body 4. Referring now to FIGS. 2-5, in this embodiment, the main body 4 is generally cylindrical in shape and has a lengthened longitudinal axis. As aforementioned, the stabilizing floats 10 may also be generally cylindrical with an elongated longitudinal axis. As demonstrated in FIG. 3, the longitudinal axis of the stabilizing floats 10 are aligned relative to the main body 4 such that the longitudinal axis of the stabilizing floats 10 are substantially parallel to the longitudinal axis of the main body 4 of the diver identification unit 2.

The diver identification unit 2 further includes a generally anterior portion 28 and a posterior portion 30, as well as a dorsal surface 32 and a ventral surface 34. The posterior portion 30 of the diver identification unit includes a threaded cap 40 that may be removed to access inner surface 8 of the main body portion for storage of a power source, such as a battery 48, and also includes space for storage for other material that a diver may find necessary to store within the unit 2. The dorsal surface 32 includes a diver movement detection switch unit 26, the flexible diver depth detection arm 18, the handle 16, electrical control module 36 and depth detection arm module 38. Additionally, the dorsal surface 32 includes an on/off switch 20 included within control module 36 which is used to activate the automatic functions of the automatic diver identification unit 2. It is contemplated that the on/off switch may be replaced with a waterproof operator interface control panel mounted such that visualization or interaction with the control panel may be accomplished at any time without having to access the inside of the dive unit. Such a control panel would be used for displaying information and functions in use, as well as serving as the interface to control or manipulate functions. Displayed information may include, but is not limited to, items such as "main power on/off", "battery life", "propulsion speed low (waves<2 feet)", "propulsion delay (seconds)", "dive line adjustment delay (seconds)", "starboard utility light", "port utility light", "center utility light", "strobe light", "reel in line manually", "surface swim propulsion on/off," or virtually any other function of the unit 2 that may be contemplated by a manufacturer of the unit as desirable for a diver.

The ventral surface includes propulsion unit 24 that allows for motorized multi-direction surface movement of the diver identification unit 2, as further described below. Propulsion unit 24 is connected to conduit 42 which is, in turn, connected to an outlet 44 of the propulsion unit. The propulsion unit 24 further includes intake 46 wherein water is drawn into intake 46, cycled through propulsion unit 24, out through conduit 42 and subsequently through outlet 44 to drive the diver identification unit 2 forward based on a response triggered from directional movement of the dive line 14. The propulsion unit 24, in one embodiment, includes an output force control that allows a user to set the output force of the propulsion unit at a desired setting. The output force control may be a manually adjusted control located on the unit 24 or, alternatively, the output force control may be incorporated in electronic control 36. The propulsion unit 24, in another embodiment, includes a control delay capable of suspending propulsion in response to a signal indicating that the diver 5 is approaching the unit 2. The propulsion unit 24 is preferably a water pump of the type generally described above; however, it is contemplated that alternative propulsion means may be used in conjunction with diver identification unit 2 described herein without departing from the spirit or scope of the invention. Alternative propulsion means may include a mechanical propeller or impeller, or any other propulsion means sufficient to drive the diver identification unit 2 through a body of water.

As previously described above, the posterior portion 30 of the automatic diver identification unit 2 includes a threaded cap 40 for access to the interior surface 8 of the main body portion 4. The cap 40 is designed to be water-tight. While it is preferred that the threaded end cap 40 provide means of access to the interior portion 8 of the main body 4, it is contemplated that access to the interior 8 may be provided by various alternate means, including, but not limited to: water-tight access doors, hatches or ports. The interior surface 8 at the posterior portion 30 of the main portion 4 comprises a sealed, water-tight compartment 50 for storage of the battery 48 and possibly other materials during use of the unit 2. The sealed water-tight compartment 50 includes threads that interact with threaded end cap 40 to provide a fluid tight seal of the compartment 50. In this manner, the battery 48 and other materials such as a diver's personal belongings may be placed in the compartment 50 and with threaded end cap 40 securely attached thereto, the automatic diver identification unit 2 provides a fluidly sealed storage area for a source of energy (e.g., battery 48) without concern that the energy source will be exposed to the elements, particularly water. Sealed compartment 50 may further include insulation 54 to provide thermal insulation, as well as fluid insulation of the sealed compartment 50.

Figure 5:
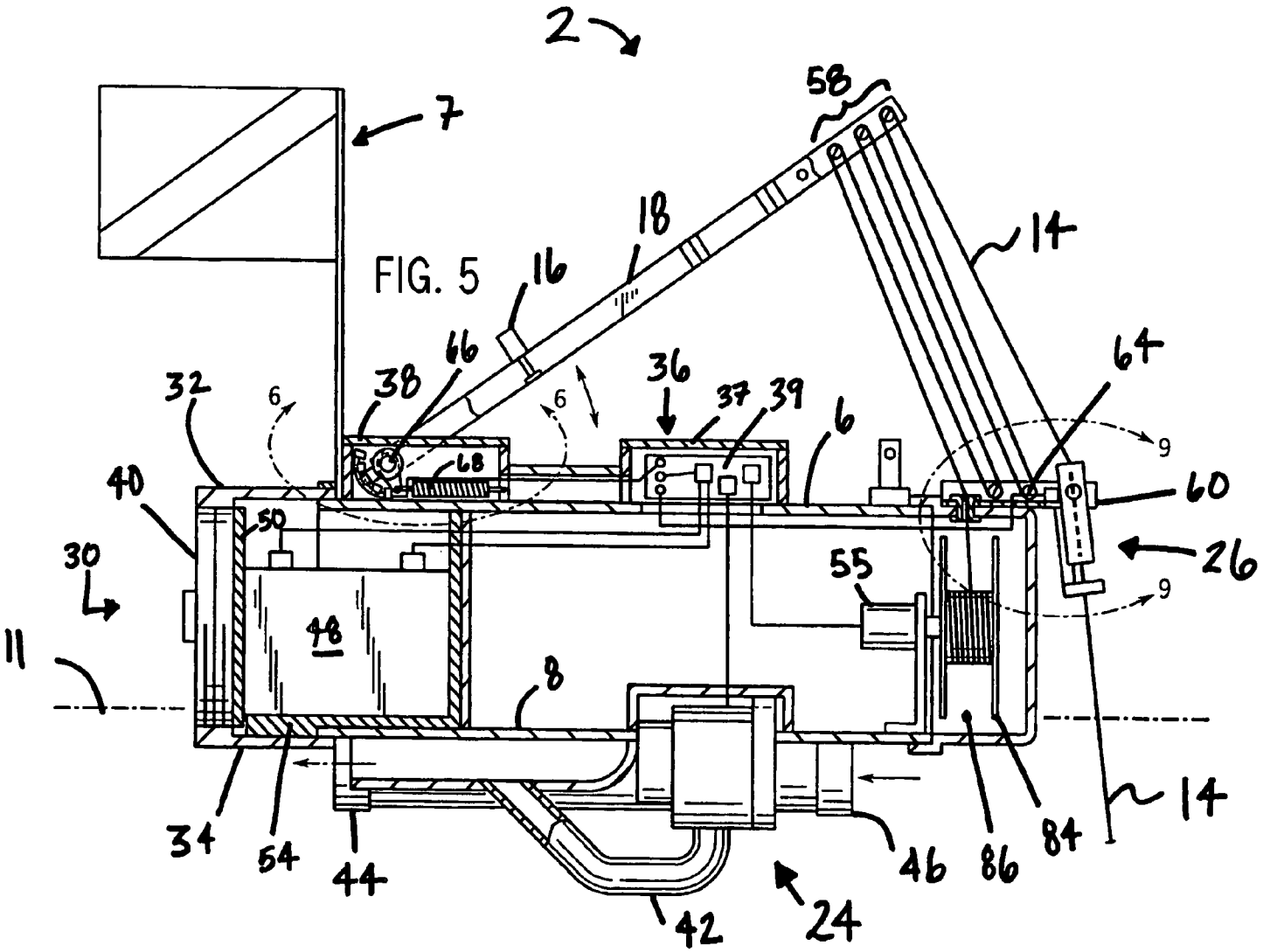
FIG. 5 is a cross-sectional view of an embodiment of the automatic diver identification unit taken along the 5-5 of FIG. 3.

Referring now to FIGS. 1, 4 and 5, therein is demonstrated the automatic diver identification unit 2 in its extended position for use on the surface of a body of water. When extended, the flexible diver depth detection arm 18 is raised and the dive line 14 is threaded therethrough. In one embodiment, the arm 18 includes three sets of rollers 58 at the anterior end of the arm 18. One of skill in the art will realize that any number of rollers 58 may be used and the decision as to the number of rollers used is based on a manufacturer's preference. The dive line 14 is threaded between rollers 58 and a diver movement detection switch unit 26, located on the anterior end 28 of the main body portion 4. Detection switch unit 26 is attached to a mount 60 that includes an opening 62 from which dive line 14 is dispensed and further includes a second series of rollers 64 through which the dive line 14 is threaded. Accordingly, the dive line is threaded from dive line dispensing opening 62 upwardly through rollers 58 of the flexible diver depth detection arm 18 and downwardly through rollers 64 of detection switch unit 26.

The purpose of the flexible diver depth detection arm 18, in conjunction with rollers 58 and 64, is to allow for movement of the arm 18 relative to the main body portion 4 in response to diver movement. However, rollers 58 and 64 in conjunction with flexible arm 18 allows for a shock absorbing action resulting from waves as well as a predetermined amount of minimal diver movement, without triggering an automatic dive line adjustment function of the unit, and without applying noticeable force onto the diver 5, all while preventing slack in the dive line 14. Tension spring 68 is adjustable and pulls the dive arm up towards the vertical position. An increase in diver depth pulls the arm 18 down thus increasing spring tension. When diver decreases depth, the spring 68 pulls the arm 18 upwardly thus removing any slack in the dive line 14. Rollers 58 and 64 in combination with dive line 14 act as a pulley system, allowing for a predetermined change in diver depth without running a dive line adjustment drive 55 and at the same time reducing the line force or pull on the diver. Thus, as the arm 18 moves as a result of the force exerted on the rollers 58 and 64 by the dive line 14, the adjustable tension spring 68 allows for mechanical control of the latitude given to the diver before any electronic line adjustment is made.

The flexible diver depth detection arm 18 is attached to the main body 4 of the diver identification unit 2 at the dorsal surface 32 at the posterior portion 30 of the unit 2 at depth detection arm module 38. The depth detection arm module 38 includes a fulcrum 66 that engages and supports flexible depth detection arm 18. Fulcrum 66 is further attached to spring 68 to allow for the arm 18 to be tensioned in a manner that it is capable of absorbing the shock from wave action and maintaining dive line 14 tension while also responding to diver movement. As will be realized by those of skill in the art, other means of attaching and tensioning the arm 18 may be utilized without departing from the spirit or scope of the invention. For example and without limitation, the fulcrum 66 may comprise any means for pivotal attachment, while the tension may be provided by springs, pulleys, elastomeric belts and the like.

Referring again to FIG. 5, electronic control module 36 is located on the dorsal surface 32 of the main body portion 4. Electronic control module 36 includes a removable top cover 37 for access to the electronic controls 39 of the diver identification unit 2. The electronic controls 39 function to manage the propulsion movement, as well as the motorized automatic dive line adjustment of the automated diver identification unit 2. The electrical controls 39, in one embodiment, include programmable software control and an electrical signal exchange. The electrical signal exchange operates in conjunction with the programmable software control, the diver depth detection arm 18 (and arm module 38), and diver movement detection switch 27 to manage the action of the dive line adjustment features and the propulsion movement of the automatic diver identification unit 2. Those of skill in the art will realize that a multitude of other control methods may be incorporated with the features of the unit 2 described herein to achieve equivalent functionality without departing from the spirit and scope of the present invention.

Figure 9:
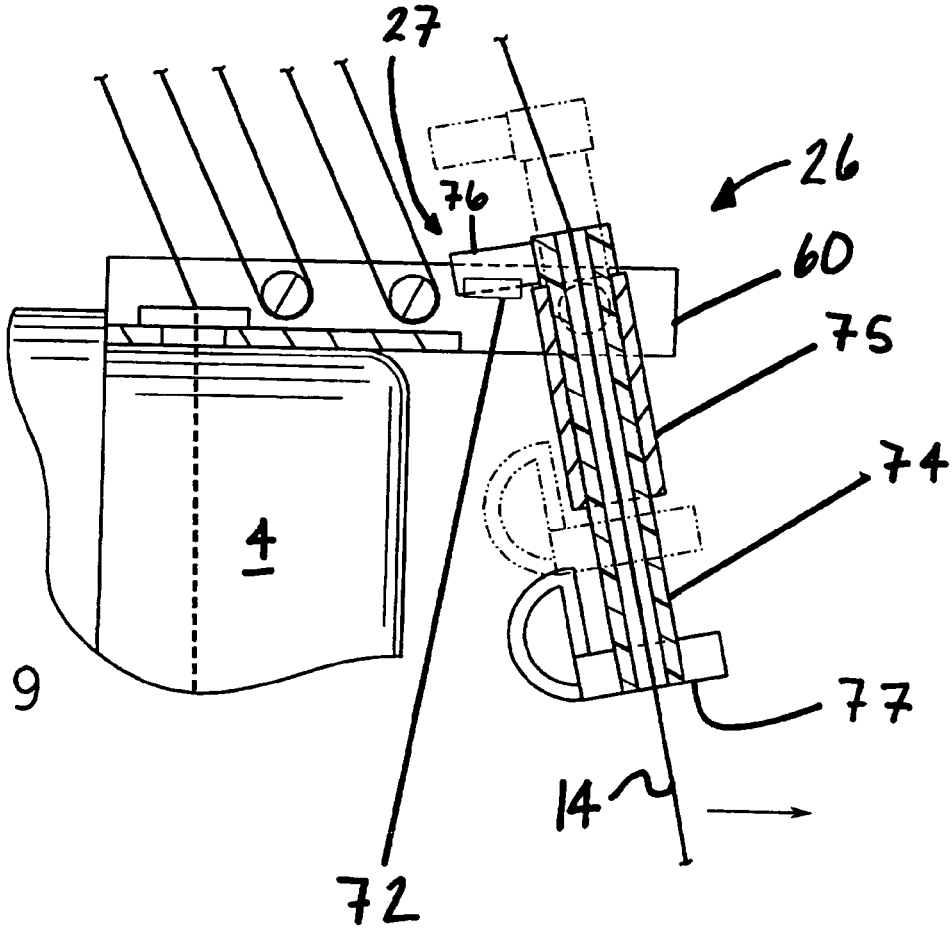
FIG. 9 is a cross-sectional view of a diver movement detection switch of an embodiment of the automatic diver identification unit taken along line 9-9 of FIG. 5 demonstrating a response of the switch to movement in a dive line.

Referring now to FIG. 9, the direction of the unit's surface movement is controlled via diver movement detection switch 27, located within detection switch unit 26, in response to the directional pull or force exerted on the dive line 14 resulting from the movement of the diver. Detection switch unit 26 functions such that when the diver moves horizontally in relation to the unit 2, such horizontal movement is recognized by the switch 27. In response to the horizontal movement being sensed, the detection switch unit 26 sends a signal to the electronic controls 39 of the unit. The electronic controls 39 then relay an activation signal to the propulsion unit 24 to activate propulsion unit 24 and move the unit 2 accordingly such that unit 2 is maintained in a position substantially directly above the diver 5. In one embodiment, the control system 39 includes a control delay that delays the relay of the activation signal to the propulsion unit 24 for a predetermined period of time.

In operation, when the diver 5 is located in a position substantially directly below the diver identification unit 2, the dive line 14 is at a normal position relative to the detection switch unit 26. When the diver moves at an angle away from a location substantially directly below the unit 2, corresponding movement of the dive line 14 is sensed by the detection switch unit 26. The electronic controls are programmed such that when the dive line 14 is at a predetermined angle from the normal position, the signal is sent to the control unit to activate the propulsion unit. The predetermined angle may be set at as small an angle as 0.5° and as large an angle as 89.5°, depending on the environmental conditions encountered during the dive experience.

Still referring to FIG. 9, the diver movement detection switch 27, in one embodiment, is further comprised of a sensor 72, a line angle detection flag 76, line guide 74, and a line guide bracket 75. The line angle detection flag 76 is connected to the line guide 74. The line guide 74, in conjunction with the line guide bracket 75, swivel to match the angle of the dive line 14 to the dive unit 2. As the diver moves away from a location substantially directly beneath the unit 2, the angle between the dive line and the unit increases. When the angle between the dive line and the unit reaches the set and predetermined angle, as discussed above, the detection flag 76 triggers the sensor 72 which activates the propulsion unit 24 via relay through the electronic control 39. Preferably, the sensor is a light-beam sensor comprised of an emitter and receiver. The flag 76, when it reaches the appropriate angle, obstructs the light beam causing a signal indicating diver movement to be sent to the control unit 39.

Figure 8:
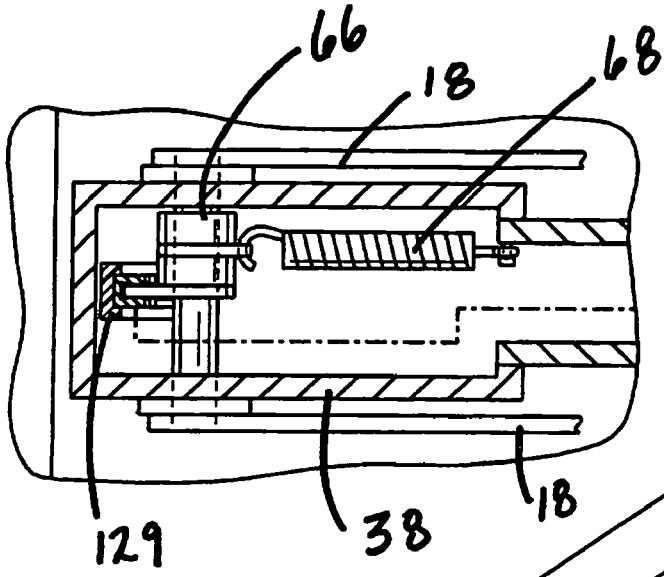
FIG. 8 is a cross-sectional view of the arm module housing of an embodiment of the automatic diver identification unit taken along line 8-8 of FIG. 6.
Figure 6:
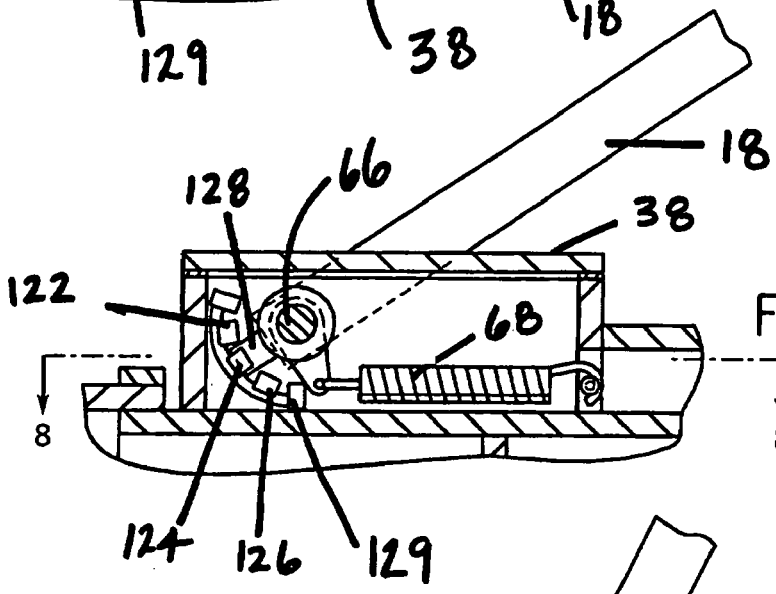
FIG. 6 is a cross-sectional view of an arm module housing of an embodiment of the automatic diver identification unit taken along line 6-6 of FIG. 5 wherein diver movement triggers and an arm position flag are demonstrated in interaction with the diver depth detection arm.
Figure 7:
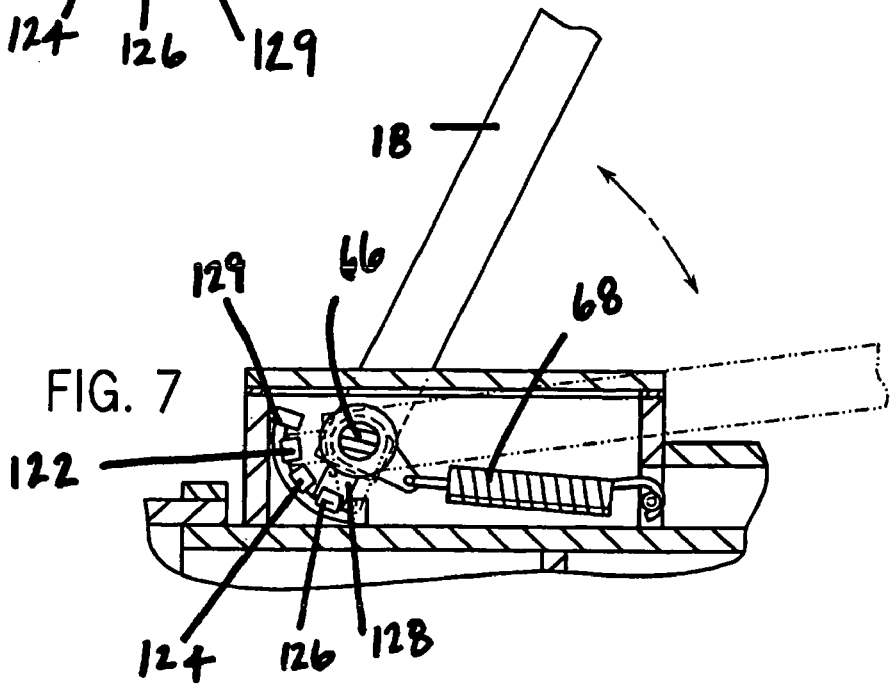
FIG. 7 is a cross-sectional view of the arm module housing of an embodiment of the automatic diver identification unit demonstrating relative movement of the arm position flag to diver movement triggers in response to movement of the diver depth detection arm.

Referring now to FIGS. 6-8, electronic controls 39 also manage the motorized, automatic adjustment of the dive line 14 based on the vertical relationship between the automatic diver identification unit 2 and the diver 5. In one embodiment, the dive line 14 is retracted or released via an automatic motor response sensed by the control system 39 through diver movement triggers 122, 124 and 126 in conjunction with arm position flag 128. When vertical movement (i.e., upwardly toward the surface of the water or downwardly toward the bottom of the body of water), is sensed through the diver movement triggers 122, 124 and 126, a signal is sent to the electronic controls 39 to actuate a dive reel drive unit 55 and cause dive line 14 to be either retracted or released. In this manner, a slack free dive line 14 is maintained between the diver and the automatic diver identification unit 2.

Referring to FIG. 5, spool compartment cavity 86 includes reel drive unit 55 that is functionally connected to the electronic controls 39. In operation, diver movement triggers 122, 124 and 126 are attached to a sensor mounting support 129, as demonstrated in FIGS. 6-8. When the flexible diver detection arm 18 moves, fulcrum 66 likewise moves and, in turn, imparts movement on arm position flag 128 to interact with triggers 122, 124 and 126. When arm position flag 128 is aligned with trigger 124, a "stop" signal is relayed to the electrical controls and either a stop signal or no signal, depending on the configuration chosen by the manufacturer, is sent to reel drive unit 55. Triggers 122 or 126 relay "retract" or "unwind" signals to the reel drive unit 55, again depending on the configuration chosen by the manufacturer. For use of discussion, trigger 122 is hereby designated as the "unwind" trigger and trigger 126 is designated as the "retract" trigger. When a diver 5 dives to a greater depth, the diver exerts tension on the dive line 14, movement is imparted on arm 18 that causes the arm position flag 128 to move from trigger 124 to "unwind" trigger 122, which relays a signal through the electronic control to the reel drive unit 55 to release line 14 from spool 84. Conversely, as demonstrated in FIG. 7, when a diver 5 moves upwardly toward the surface of the water, slack forms in the dive line 14 and tension is removed causing arm position flag 128 to move to the "retract" trigger 126, which relays a signal to through the electrical control to the reel drive unit 55 to wind dive line 14 onto spool 84. In one embodiment, the controls 39 incorporate a delay for dive line adjustment. The delay operates to suspend the "retract" or "unwind" signals sent to the reel drive unit 55 for a predetermined period of time.

In operation, when a diver 5 ascends upwardly toward the surface 11 of a body of water, the unit 2 retracts the dive line 14 until a safety stop (not shown) reaches a bottom surface 77 of the line guide 74. The safety stop is affixed to the dive line 14 at a predetermined and adjustable distance from the diver. When the safety stop reaches the bottom surface 77 of the line guide 74, the line guide 74 is pushed upwardly, a demonstrated in FIG. 9, moving the line angle detection flag 76 out of the range of sensor 72, regardless of the angle, thereby ensuring that propulsion unit 24 is stopped.

It is foreseen that unit 2 could be modified and used to assist a diver to surface swim, such a when a diver might be surface swimming to a dive site or surface swimming back to a dive boat or the shore at the end of a dive. With this modification, the unit will have a power on/off control for the diver surface swim assist function, and a dual-trigger handle system will be incorporated so that a diver may grasp and hold onto the unit while controlling and triggering the propulsion system.

While several forms of the invention have been shown and described herein, other forms will now be apparent to those of skill in the art. Therefore, it will be understood that the embodiment shown in the drawings and described above are merely for illustrative purposes, and are not intended to limit the scope of the invention which is defined by the claims which follow as interpreted according to the principles of patent law, including the doctrine of equivalents.

What is claimed is:

1. A hands free flotation device that identifies the position of a diver at the surface of a body of water for use in underwater diving comprising:

a buoyant main body portion having an outer surface and an inner surface, said inner surface defining at least one interior chamber;

a dive line supply means attached to the main body portion;

a propulsion means;

an electronic control system interconnected with the dive line supply means and the propulsion means; and an identification means;

wherein the dive line supply means supplies a dive line connected to the underwater diver and further provides automated adjustment of a dive line in response to a signal sent from the electronic control system identifying the depth of an underwater diver; and wherein the propulsion means includes a diver movement detection switch interconnected with the electronic control system to propel the device on the surface of the body of water in response to a signal indicating movement of the underwater diver.

2. The device of claim 1, wherein the propulsion means further comprises a control delay, said control delay capable of suspending propulsion in response to a signal indicating movement of the underwater diver for a determined period of time.

3. The device of claim 1, wherein the propulsion means further comprises a safety stop, said safety stop automatically stopping propulsion in response to a signal indicating the underwater diver approaching the device.

4. The device of claim 1, wherein the propulsion means further comprises an output force control, said output force control allowing a user to set the output force of the propulsion means at a desired setting.

5. The device of claim 1, wherein the dive line supply means further comprises a flexible arm that operates to sense the depth of the underwater diver and further includes a dive line spool and a driver for the dive line spool.

6. The device of claim 5, wherein the dive line spool and driver are located within said at least one interior chamber of said main body.

7. The device of claim 5, wherein the dive line supply means is mounted on the outer surface of said main body.

8. The device of claim 1, wherein the dive line supply means further comprises a control delay, said control delay capable of automatically suspending a signal to effect the automated dive line adjustment for a determined period of time.

9. The device of claim 1 wherein the identification means comprises a signal to identify the location of the device and the signal is selected from the group consisting of: a visual signal, an audio signal, a radio signal, a satellite signal, and a combination thereof.

10. The device of claim 1 wherein the electronic control system further comprises a diver movement detection switch connected to an electrical signal exchange.

11. The device of claim 1 wherein at least one flotation member is attached to the main body portion.

12. An automatic diver identification unit for providing motorized and multi-directional surface movement relative to a position of an underwater diver when the diver is diving at a depth to identify the position of the diver at the surface of a body of water, the unit comprising:

a buoyant main body portion having an outer surface and an inner surface, said inner surface defining at least one interior chamber;

an electronic control system comprising at least one diver movement detection switch connected to an electrical signal exchange;

an energy source interconnected with the electronic control system;

a dive line supply means interconnected with the electronic control system and energy source and further attached to the main body portion of the unit to provide a dive line to the underwater diver and provide automated adjustment of a dive line relative to a signal received from the electronic control system indicating the depth of the underwater diver;

a propulsion means interconnected with the electronic control system and energy source to propel the unit on the surface of the body of water relative to and in response to a signal received from the electronic control system identifying movement of the underwater diver; and an identification means comprising a signal to identify the location of the unit.

13. The automatic diver identification unit of claim 12, wherein said at least one diver movement detection switch comprises a line guide, an angle detection sensor and an angle detection flag, wherein the angle detection flag detects the angle of the dive line relative to the line guide, the dive line having a normal position to the line guide when the dive line extends to a position substantially directly below the unit, and further wherein the angle detection sensor is activated when the detection flag detects that the dive line is at an angle greater than a predetermined angle from normal to the line guide to send a signal to the electronic control system indicating diver movement.

14. The automatic diver identification unit of claim 12, wherein said at least one diver movement detection switch comprises at least two diver movement triggers responsive to tension in a dive line, wherein when tension is increased on the dive line a first trigger is activated to relay a signal through the electronic control system to the dive line supply means to release dive line from the dive line supply means, and further wherein when tension is decreased on the dive line, a second trigger is activated to relay a signal through the electronic control system to the dive line supply means to retract line onto the dive line supply means.

15. The automatic diver identification unit of claim 14, wherein the diver movement detection switch further comprises a third diver movement trigger to relay a signal through the electronic control system to the dive line supply means to stop either release or retract of the dive line supply means.

16. The automatic diver identification unit of claim 12, wherein the dive line supply means further comprises a flexible arm that operates to sense the depth of the underwater diver, a dive line spool and a driver for the dive line spool, and wherein the driver is connected to the electronic control system to receive signals from the electronic control system.

17. The automatic diver identification unit of claim 12, wherein the propulsion means further comprises a control delay, said control delay capable of suspending propulsion in response to a signal indicating movement of the underwater diver for a determined period of time.

18. The automatic diver identification unit of claim 12, wherein the propulsion means further comprises a safety stop, said safety stop automatically stopping propulsion in response to a signal indicating the underwater diver approaching the diver identification unit.

19. The automatic diver identification unit of claim 15, wherein the unit comprises a second diver movement detection switch, the second diver movement detection switch comprising a line guide, an angle detection sensor and an angle detection flag, wherein the angle detection flag detects the angle of the dive line relative to the line guide, the dive line having a normal position to the line guide when the dive line extends to a position substantially directly below the unit, and further wherein the angle detection sensor is activated when the detection flag detects that the dive line is at an angle greater than a predetermined angle from normal to the line guide to send a signal to the electronic control system indicating diver movement.

20. The automatic diver identification unit of claim 12, wherein the identification signal is selected from the group consisting of: a visual signal, an audio signal, a radio signal, a satellite signal, and a combination thereof; and wherein at least one flotation member is attached to the main body portion.

21. The automatic diver identification unit of claim 12, wherein the dive line supply means further comprises a control delay, said control delay capable of automatically suspending a signal to effect the automated dive line adjustment for a determined period of time.

* * * * *